United States Patent [19]

Green

[11] Patent Number: 4,640,239

[45] Date of Patent: Feb. 3, 1987

[54] DISTRIBUTOR FOR SPARK IGNITION INTERNAL COMBUSTION ENGINE

[75] Inventor: Robert Green, West Midlands, United Kingdom

[73] Assignee: Austin Rover Group Limited, Coventry, United Kingdom

[21] Appl. No.: 715,264

[22] Filed: Mar. 25, 1985

[30] Foreign Application Priority Data

Mar. 28, 1984 [GB] United Kingdom ..... 8408019

[51] Int. Cl.[4] ..... F02P 1/00

[52] U.S. Cl. ..... 123/146.5 A; 123/195 A

[58] Field of Search ..... 123/146.5 A, 195 A; 200/19 R, 19 DC

[56] References Cited

U.S. PATENT DOCUMENTS

| | | | |
|---|---|---|---|
| 4,333,433 | 6/1982 | Mattson | 123/146.5 A |
| 4,454,856 | 6/1984 | Fox | 123/146.5 A |

FOREIGN PATENT DOCUMENTS

| | | | |
|---|---|---|---|
| 0044578 | 6/1981 | European Pat. Off. | 123/146.5 A |
| 451924 | 9/1936 | United Kingdom | 123/146.5 A |
| 1244742 | 9/1971 | United Kingdom | 123/146.5 A |

*Primary Examiner*—Ronald B. Cox

*Attorney, Agent, or Firm*—Thomas J. Greer, Jr.

[57] ABSTRACT

A distributor for a spark ignition internal combustion engine is driven via a drive spindle 3 which is held via a resilient bush 4 in a drilling in the end of a camshaft 1 of the engine which operates the usual valve gear. Advance and retard are performed electronically. The resilient bush protects the drive spindle 3 and rotor from vibrations of the camshaft.

10 Claims, 3 Drawing Figures

DISTRIBUTOR FOR SPARK IGNITION INTERNAL COMBUSTION ENGINE

This invention relates to distributors for spark ignition internal combustion engines.

Such distributors are conventionally driven by skew gearing from a camshaft of the engine that operates the valve gear.

The invention provides a distributor for a spark ignition internal combustion engine, wherein in use the rotor is driven by a spindle which is mounted in a resilient bush in a cylindrical recess in the end of a camshaft of the engine.

The resilient bush tends to protect the drive spindle and rotor from vibrations of the camshaft.

The advance and retard functions may be carried out electronically, the rotor arm having a sufficient contact area with the contacts for the various distributor leads to the engine to permit a desired variation in spark timing.

A distributor for a spark ignition internal combustion engine will now be described, by way of example, with reference to the accompanying drawings, in which.

Figure 2:
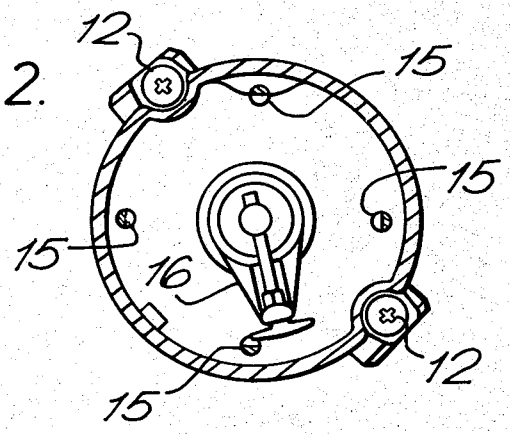
FIG. 2 is a plan view of the distributor.
Figure 1:
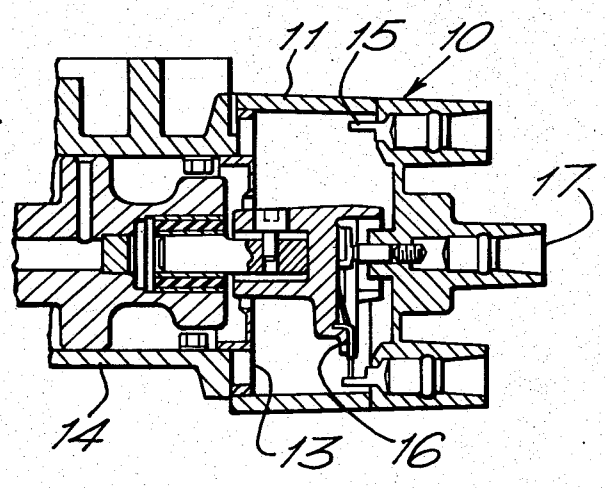
FIG. 1 is an axial cross-section through the axis of the rotor shaft and its camshaft drive.
Figure 3:
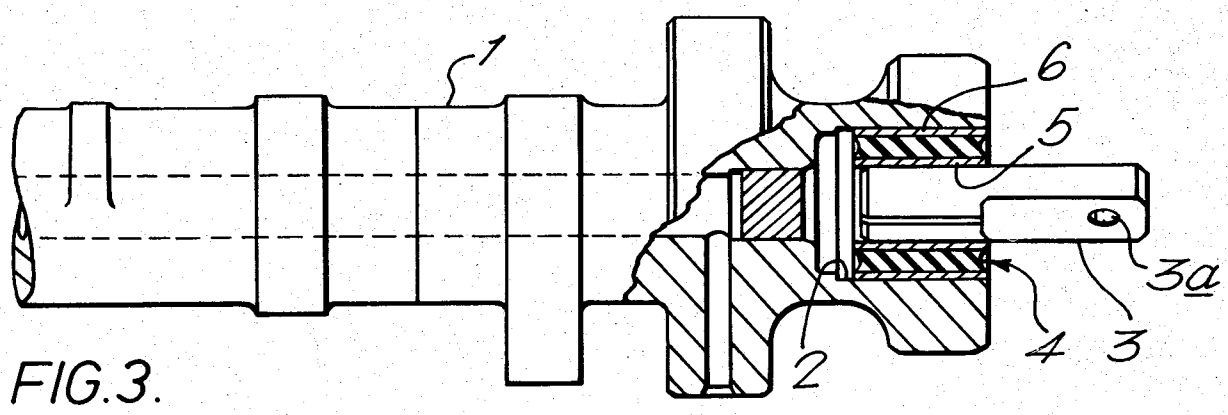
FIG. 3 is an axial cross-section on an enlarged scale of the camshaft drive of the distributor.

The distributor indicated generally by the reference numeral 10 consists of a distributor cap 11 secured by two screws 12 to a mounting plate 13 which is secured to a housing 14 surrounding a camshaft 1 of the engine. The distributor has four peripheral contacts 15 (since the engine has four cylinders) which are swept by a rotor arm 16 which is supplied with high voltage from a central contact 17. The rotor arm 16 brushes over the peripheral contacts to distribute the high voltage via leads to the cylinders in the usual way.

The overhead camshaft 1 of the internal combustion engine is arranged for rotation at half engine speed and operates the vave gear in the usual way.

One end of the camshaft has a drilling 2 which receives a drive spindle 3 of a distributor rotor mounted in a resilient bush indicated generally by the reference numeral 4. The rotor arm 16 is secured to the spindle by means of a bolt passing through aperture 3*a*, the part of the spindle extending clear of the bush being D-sectioned.

The high voltage is generated electronically instead of by the usual cam opening a contact, and advance and retard functions are also performed electronically. For this reason, the rotor has a wide contact blade area to allow variation in the time which the high voltage is passed to each cylinder.

The resilient bush 4 consists of an inner sleeve 5 and an outer sleeve 6 to which is bonded rubber of other resilient material. The spindle 3 is in interference fit with the inner sleeve 5 and, during asembly, is inserted into the resilient bush 4. The outer sleeve 6 is in interference fit with the drilling 2 in the end of the camshaft, and the assembly of spindle 3 and bush 4 is pressed into the drilling 2 until the bush is flush with the end of the camshaft. The bush is clear of the bottom of the drilling in order that the spindle 3 is supported via the resilient material of the bush.

The resilient bush tends to protect the drive spindle 3 and rotor arm 16 from vibrations of the camshaft. In tests it has been found that, if bush 4 is omitted, the rotor arm has a very short life.

I claim:

1. A distributor and camshaft combination for a spark ignition internal combustion engine, the rotor of the distributor connected to and driven by a spindle which is mounted in a resilient elastomeric bushing, the bushing mounted in a recess in an end of the camshaft, whereby the life of the rotor arm is extended.

2. The distributor as claimed in claim 1, wherein the drive spindle has an aperture and a bolt passes through the aperture to secure the rotor to the spindle.

3. The distributor of claim 1, wherein the resilient bushing is bonded to an inner sleeve and an outer sleeve, the drive spindle being a press fit in the inner sleeve and the outer sleeve being a press fit in the camshaft end recess.

4. The distributor of claim 1, wherein the resilient bushing is formed of rubber.

5. The distributor of claim 3, wherein the resilient bushing is formed of rubber.

6. A distributor and camshaft combination for a spark ignition internal combustion engine, the rotor of the distributor connected to and driven by a spindle which is mounted in a resilient bushing, the bushing mounted in a recess in an end of the camshaft, one end of said spindle extending into said recess, whereby the life of the rotor arm is extended.

7. The distributor as claimed in claim 6, wherein the drive spindle has an aperture and a bolt passes through the aperture to secure the rotor to the spindle.

8. The distributor of claim 6, wherein the resilient bushing is bonded to an inner sleeve and an outer sleeve, the drive spindle being a press fit in the inner sleeve and the outer sleeve being a press fit in the camshaft end recess.

9. The distributor of claim 6, wherein the resilient bushing is formed of rubber.

10. The distributor of claim 8, wherein the resilient bushing is formed of rubber.

* * * * *